United States Patent [19]

Pochyly

[11] 4,087,211

[45] May 2, 1978

[54] DRIVING UNIT FOR VERTICAL PUMP

[75] Inventor: František Pochylý, Olomouc, Czechoslovakia

[73] Assignee: Sigma Lutin, narodni podnik, Lutin, Czechoslovakia

[21] Appl. No.: 735,393

[22] Filed: Oct. 26, 1976

[30] Foreign Application Priority Data

Oct. 30, 1975 Czechoslovakia ..... 7311/75

[51] Int. Cl.[2] ..... F04B 17/00

[52] U.S. Cl. ..... 417/424; 415/111; 415/501; 417/405

[58] Field of Search ..... 415/110, 111, 501, 88; 417/424, 360, 405

[56] References Cited

U.S. PATENT DOCUMENTS

| | | | |
|---|---|---|---|
| 633,478 | 9/1899 | Northam et al. | 417/424 |
| 975,526 | 11/1910 | Hood | 417/424 |
| 1,320,736 | 11/1919 | Chapman | 415/111 |
| 1,423,496 | 7/1922 | Haney | 415/110 |
| 1,435,400 | 11/1922 | Layne | 417/424 |
| 1,586,900 | 6/1926 | Hollander | 417/424 |
| 1,704,362 | 3/1929 | Johnson | 415/111 |
| 1,739,803 | 12/1929 | Schlegel et al. | 415/111 |
| 1,974,014 | 9/1934 | Coats | 417/424 |
| 3,816,020 | 6/1974 | Ogles | 415/111 |

FOREIGN PATENT DOCUMENTS

| | | | |
|---|---|---|---|
| 660,015 | 7/1929 | France | 415/501 |
| 1,083,654 | 6/1960 | Germany | 415/88 |
| 868,110 | 2/1953 | Germany | 417/424 |
| 190,948 | 7/1923 | United Kingdom | 415/501 |
| 254,832 | 7/1926 | United Kingdom | 415/501 |

*Primary Examiner*—C. J. Husar

[57] ABSTRACT

Driving unit for a vertical shaft-driven pump for pumping liquids from wells and deep bore holes through a riser pipe, the driving unit having a cross-shaped base, a top flange mounting a prime mover such as an electric motor, radially disposed supporting ribs and upwardly and radially inwardly inclined reinforcing webs. A bearing box is disposed on the central axis of the driving unit assembly between the ribs, a stuffing box, forming a part of the riser pipe being disposed in the cross-shaped base. The driving unit, without any alteration thereof, permits the use of a branch, liquid delivering pipe which extends laterally either below or above the cross-shaped base, and in the latter case, between any two adjacent arms of the cross-shaped base of the driving unit assembly.

6 Claims, 2 Drawing Figures

Figure 1:
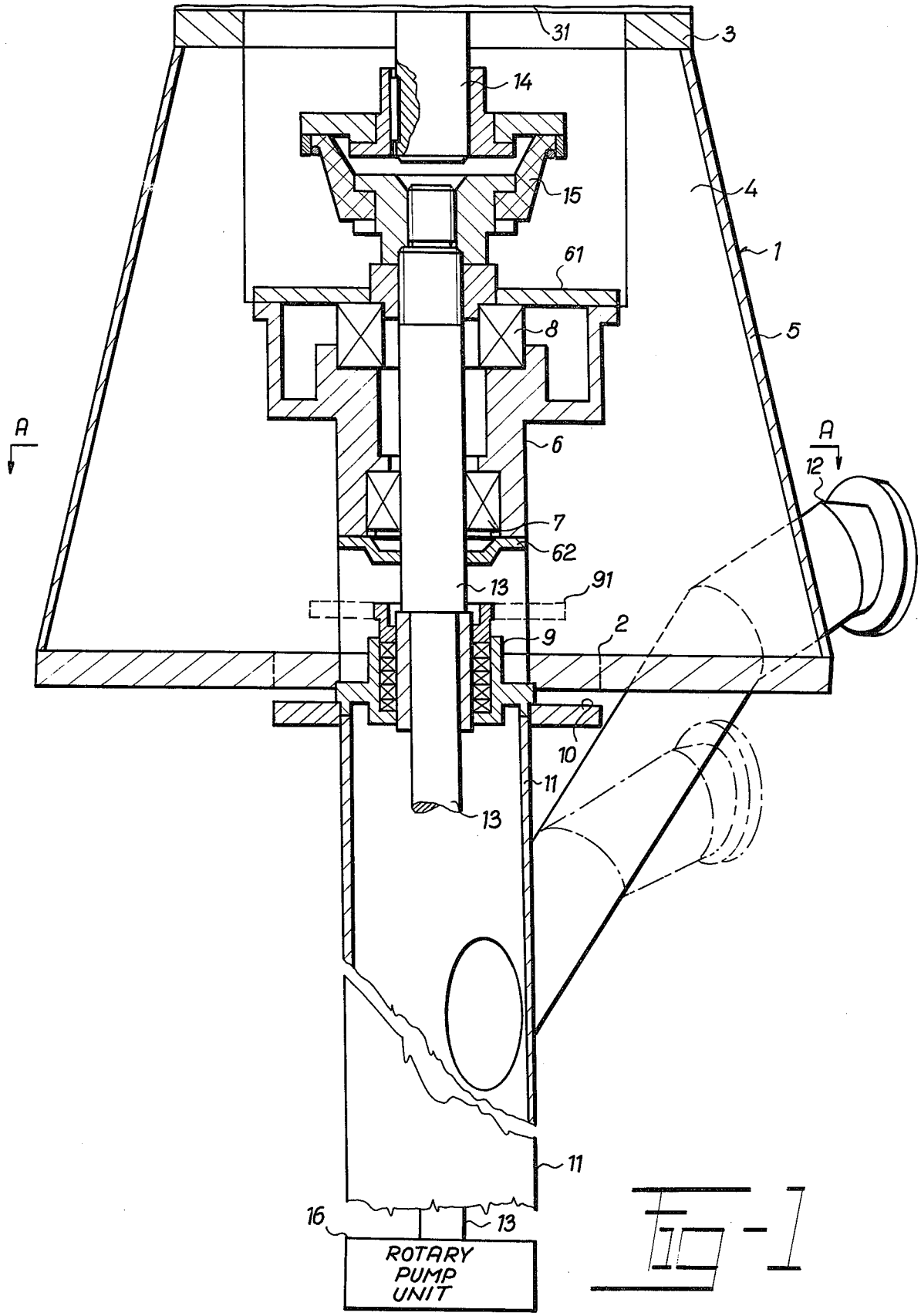

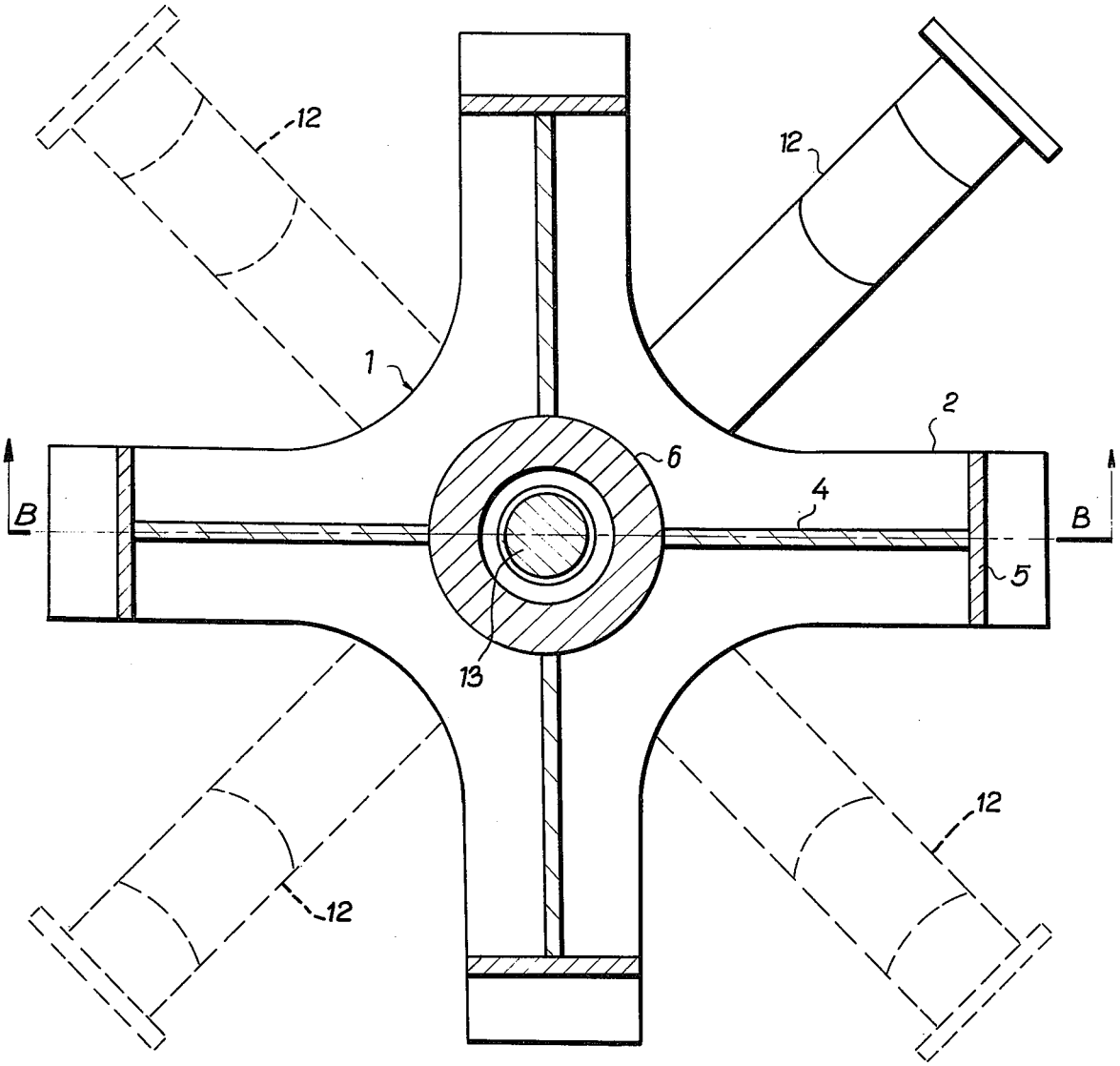
図-2

DRIVING UNIT FOR VERTICAL PUMP

The present invention relates to a driving unit for a vertical, shaft-driven pump for pumping liquids from wells and deep bore-holes.

With well-known designs of vertical pumps for pumping liquids from wells and deep bore-holes, such pumps having a driving unit above the ground and a pump housing mounted at the bottom of a long drive shaft, there are commonly used two types of suspensions, depending on the position of the branch, liquid delivering pipe connected to the vertical riser pipe accommodating said long drive shaft. In both types the driving means for the pump has a coupling connecting the drive shaft with the shaft of the driving means located on the top of an upper housing of a base plate with bearings supporting the upper housing, of a stuffing box and a branch, delivery pipe.

In a first prior design, wherein the branch pipe is situated under the base plate, the drive shaft is connected with the shaft of the driving means by means of a permanent coupling, and is supported in both a radial bearing and an axial or thrust bearing. Both of such bearings are arranged in the base plate, where especially said radial bearing must be mounted with high precision in order not to be a source of undesired oscillations. The stuffing box is situated under the base plate immediately above the branch pipe, which makes access to it difficult. With such an embodiment, the stuffing box can also be the source of undesired oscillations when the gland follower is not tightened correctly.

In the second prior design, in which the mouth of the branch pipe is disposed above the base plate, said branch pipe forms a separate structure supporting the base plate with the bearing box, and the drive shaft is again connected to the shaft of the driving unit, disposed on the upper housing, by means of a permanent coupling.

In both prior designs, a considerable number of parts must be made with close tolerances and assembled with high precision. Besides this, the parts as well as the assemblies of such two prior designs of pump driving means are not interchangeable.

An object of the invention is to provide a new driving means for a vertical shaft-driven pumping unit having improved dynamic properties, a lower number of parts, wherein the precision of manufacture need not be unduly high and which can be used in a number of positions of the branch pipe.

In accordance with the invention, the driving means for a vertical shaft-driven pump for pumping liquids from wells and deep bore holes through a riser pipe comprises a supporting body, a coupling, a stuffing box, a bearing box and a branch, liquid delivering pipe, wherein the supporting body is formed by a supporting assembly having a cross-shaped base, a top flange for mounting a driving means or prime mover such as an electric motor, radially disposed supporting ribs and upwardly and radially inwardly inclined reinforcing webs, a bearing box being disposed on the central axis of the supporting assembly between the supporting ribs, and a stuffing box, forming a part of a flange of the riser pipe arranged in the cross-shaped base.

Further, in accordance with the invention, a branch pipe is disposed on the riser pipe so that it is located between two adjacent arms of a cross-shaped base.

Finally, in accordance with the invention, a flexible coupling for the transmission of torque from the shaft of the driving means to the long drive shaft is located above a bearing box between supporting ribs.

The driving means according to the invention is of advantage because of its flexibility of application, simple manufacture and machining, its reduction of the number of parts required, its optimum use of material, and by its higher operational reliability.

One form of the driving means embodying the invention will now be described with reference to the accompanying drawings.

IN THE DRAWINGS

FIG. 1 is a diagrammatic sectional view of a preferred driving unit and pump, the section being taken along line B—B in FIG. 2, one configuration the branch pipe being shown in full lines, an alternative embodiment of the branch pipe being shown in phantom lines, and FIG. 2 is a cross-sectional view of the driving means shown in FIG. 1, the section being taken along line A—A in FIG. 1; one position of the branch pipe being shown in full lines, three other alternative positions of the branch pipe being shown in phantom lines.

Referring to the drawing, the driving means for a vertical shaft-driven pump for pumping liquids from wells and deep bore-holes comprises a supporting assembly functioning as a base plate and an upper housing, and consisting of a cross-shaped base 2, a top flange 3 corresponding to the shape of the flange of a rotary prime mover such as an electric motor 31, radially disposed supporting ribs 4 and upwardly and radially inwardly inclined reinforcing webs 5. On the central axis, between the supporting ribs 4, there is disposed a bearing box 6 provided with covers 61, 62 and housing both a radial ball or roller bearing 7 and an axial ball or roller thrust bearing 8. In the cross-shaped base 2, there is disposed a stuffing box 9 forming a part of an upper flange 10 of a riser pipe 11 serving to suspend the latter on the cross-shaped base 2 of the supporting assembly 1.

A branch-pipe 12 is arranged on the riser pipe 11 so that it passes between any two adjacent arms of the cross-shaped base 2 as indicated in FIG. 1, pipe 12 can terminate either under (as shown in phantom lines) or above (as shown in full lines) the cross-shaped base 2 of the supporting assembly 1. A drive shaft 13 contained inside the riser pipe 11 and passing through the stuffing box 9 is supported by both the radial bearing 7 and the axial bearing 8 in assembly 1 and is connected with the shaft 14 of the drive unit 31 by means of a flexible coupling 15. The stuffing box 9 is closed by a gland follower 91. As shown in FIG. 1, the lower end of drive shaft 13 is connected to a rotary deep well pumping unit 16 within riser pipe 11.

The supporting assembly 1 of the driving means fully takes over the functions of both the base plate and the upper housing of known designs; it is of simple design and permits easy access to the coupling 15, both the bearings 7, 8, and to the stuffing box 9 due to its cross-shaped design. Disposing the stuffing box 9 in the vicinity of the nodal point of the bearings 7, 8 decreases the danger of setting up undesired oscillations of the driving shaft 13; such oscillations, as noted above, were caused in previous designs by variations in the tightening force of the gland followers of the stuffing box which was situated beneath the nodal point of the bearings. The new supporting assembly of the driving means of the invention can be used for both arrangements of locating the branch-pipe, that is, above or below the cross-shaped base 2, without any alterations.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A driving unit for a vertical shaft-driven pump for pumping liquids from deep wells and bore-holes, the pump having a rotary pumping unit disposed within a riser pipe and pumping liquid upwardly therethrough into a laterally extending branch pipe joined to the riser pipe adjacent the upper end of the latter, the driving unit comprising a supporting assembly having a cross-shaped base mounted on the top of the riser pipe, a radially disposed supporting rib extending upwardly from each arm of the base, a top flange for supporting a prime mover with a vertical shaft mounted on the upper ends of the ribs, a central bearing box having bearings receiving the upper end of the pump driving shaft within the upper end of the riser pipe, the bearing box being supported on the supporting assembly between the base and top flange thereof, a coupling drivingly connecting the shaft of the prime mover with the upper end of the pump driving shaft, and a stuffing box on the assembly forming a seal between the upper end of the riser pipe and the pump driving shaft, the branch pipe being disposed generally in a vertical plane radial of the riser pipe midway between two successive arms of the base of the assembly.

2. The combination of claim 1, wherein the branch pipe extends upwardly between said arms of the base.

3. The combination of claim 1, wherein the bearing box is secured to the radially inner edges of the supporting ribs.

4. The combination of claim 3, wherein the coupling is flexible and is located above the bearing box and between the base and top flange of the assembly.

5. The combination of claim 1, wherein the base and top flange are coaxial, the top flange is of substantially smaller radius than the radial length of the arms of the base, and the radially outer edges of the supporting ribs are inclined upwardly and radially inwardly from the outer ends of the respective arms of the base generally to the outer edge of the top flange.

6. The combination of claim 5, comprising reinforcing webs disposed in planes normal to the outer edges of the respective supporting ribs, said webs being secured to the arms of the base, the ribs, and the top flange of the assembly.

* * * * *